US006178859B1

(12) United States Patent
Pomerleau et al.

(10) Patent No.: US 6,178,859 B1
(45) **Date of Patent: *Jan. 30, 2001**

(54) APPARATUS FOR CUTTING SHEET MATERIAL

(75) Inventors: Robert J. Pomerleau, Springfield, MA (US); Joseph R. Vivirito, South Windsor; Ivan Markowitz, Glastonbury, both of CT (US)

(73) Assignee: Gerber Technology, Inc., Tolland, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/968,980

(22) Filed: Nov. 12, 1997

Related U.S. Application Data

(62) Division of application No. 08/525,412, filed on Sep. 8, 1995, now Pat. No. 5,727,433.

(51) Int. Cl.[7] ..... B26D 5/00

(52) U.S. Cl. ..... 83/76.9; 83/941; 83/368; 83/451; 83/100

(58) Field of Search ..... 83/22, 24, 29, 83/39, 49, 56, 76.1, 76.6, 76.7, 76.8, 76.9, 451, 940, 941, 100, 650, 936, 937, 938, 939

(56) References Cited

U.S. PATENT DOCUMENTS

| | | | | |
|---|---|---|---|---|
| 1,927,976 | * | 9/1933 | Evans | 83/650 |
| 3,391,392 | | 7/1968 | Doyle | 340/172.5 |
| 3,473,157 | | 10/1969 | Little et al. | 340/172.5 |
| 3,534,396 | | 10/1970 | Hart et al. | 235/61.6 |
| 3,596,068 | | 7/1971 | Doyle | 235/150 |
| 3,693,154 | | 9/1972 | Kubo et al. . | |
| 3,766,528 | | 10/1973 | Ichida | 340/172.5 |
| 3,803,960 | * | 4/1974 | Pearl et al. | 83/56 |
| 3,805,650 | * | 4/1974 | Pearl | 83/56 |
| 3,811,113 | | 5/1974 | Saito et al. | 340/172.5 |
| 3,887,903 | | 6/1975 | Martell | 340/172.5 |
| 3,895,355 | | 7/1975 | Shorrock | 340/172.5 |
| 3,924,244 | | 12/1975 | Seitz | 340/172.5 |
| 4,058,849 | | 11/1977 | Fitzgerald et al. | 364/520 |
| 4,149,246 | | 4/1979 | Goldman | 364/200 |
| 4,151,770 | * | 5/1979 | D'Angelo et al. | 83/650 |
| 4,178,820 | * | 12/1979 | Gerber | 83/56 |
| 4,288,851 | * | 9/1981 | Manabe et al. | 83/56 |

(List continued on next page.)

OTHER PUBLICATIONS

Kinematics and Dynamics of Machinery, Charles E. Wilson, J. Peter Sadler, Walter J. Michels, Harper & Row, Publishers, New York, ISBN 0–06–044437–1, 1983.*

*Primary Examiner*—Rinaldi I. Rada
*Assistant Examiner*—Kim Ngoc Tran
(74) *Attorney, Agent, or Firm*—McCormick, Paulding & Huber LLP

(57) ABSTRACT

A method and apparatus for cutting sheet material allows multiple layups of sheet material to be cut in side-by-side or stacked relationship on the cutting table of a computer controlled cutting machine. A different marker or array of pattern pieces can be cut from each of the stacked layups. Also, for certain layups, whether stacked or not, markers are located with reference to the centerline of the layup to insure that the pattern pieces of the marker are cut symmetrically or in alignment with ornamentation or designs in the material.

8 Claims, 6 Drawing Sheets

OTHER PUBLICATIONS

| | | | | |
|---|---|---|---|---|
| 4,429,364 | | 1/1984 | Maruyama et al. | 364/400 |
| 4,451,895 | | 5/1984 | Sliwkowski | 364/521 |
| 4,539,585 | | 9/1985 | Spackova et al. | 358/93 |
| 4,546,434 | | 10/1985 | Gioello | 364/300 |
| 4,552,991 | | 11/1985 | Hulls | 178/19 |
| 4,570,033 | | 2/1986 | Hulls | 178/19 |
| 4,572,761 | * | 2/1986 | Phillips, Sr. | 83/650 |
| 4,598,376 | | 7/1986 | Burton et al. | 364/470 |
| 4,621,959 | | 11/1986 | Kishi et al. | 409/84 |
| 4,697,050 | | 9/1987 | Farel et al. | 178/18 |
| 4,704,694 | | 11/1987 | Czerniejewski | 364/513 |
| 4,725,961 | | 2/1988 | Pearl | 364/475 |
| 4,739,487 | | 4/1988 | Bonnet et al. | 364/475 |
| 4,744,035 | | 5/1988 | Hashim | 364/470 |
| 4,771,663 | * | 9/1988 | Naito et al. | 83/49 |
| 4,807,143 | | 2/1989 | Matsurva . | |
| 4,853,715 | | 8/1989 | Paschkis | 346/139 |
| 4,901,359 | | 2/1990 | Bruder | 382/8 |
| 4,941,183 | | 7/1990 | Bruder et al. | 382/8 |
| 4,961,149 | | 10/1990 | Schneider et al. . | |
| 4,963,703 | | 10/1990 | Phillips et al. | 178/19 |
| 4,982,437 | | 1/1991 | Loriot | 382/8 |
| 5,027,416 | | 6/1991 | Loriot | 382/8 |
| 5,068,799 | | 11/1991 | Jarrett, Jr. | 364/507 |
| 5,089,971 | | 2/1992 | Gerber | 364/470 |
| 5,146,821 | * | 9/1992 | Bruder et al. | 83/56 |
| 5,172,326 | | 12/1992 | Campbell, Jr. et al. . | |
| 5,175,806 | | 12/1992 | Muskovitz et al. . | |
| 5,216,614 | * | 6/1993 | Kuchta et al. | 83/49 |
| 5,258,917 | | 11/1993 | Bruder et al. | 364/474.13 |
| 5,341,305 | | 8/1994 | Clarino et al. | 364/470 |
| 5,406,872 | * | 4/1995 | Conley, Jr. et al. | 83/650 |
| 5,727,433 | * | 3/1998 | Pomerleau et al. | 83/76.8 |
| 5,791,215 | * | 8/1998 | Morrison et al. | 83/13 |

* cited by examiner

APPARATUS FOR CUTTING SHEET MATERIAL

This is a divisional of application Ser. No. 08/525,412 filed on Sep. 8, 1995 now U.S. Pat. No. 5,727,433.

BACKGROUND OF THE INVENTION

The present invention relates to a method and apparatus for cutting sheet material, particularly limp sheet material such as cloth, paper, plastic and the like which is held in a spread condition while it is worked on by a tool such as a cutting blade, drill or other tool.

In the prior art, it is well known to spread cloth and other limp sheet materials on a support surface for cutting, drilling and other operations. In the garment industry it is known to spread cloth in single or multiple plies on a cutting table having an air-permeable bed, and to then cut pattern pieces from the material. The pattern pieces are then assembled in garments or other finished articles by cutting blades, lasers, water jets and other types of tools.

A conveyorized vacuum table formed with bristle beds for loading layups of one or more plies of sheet material onto the bed holds the layups in a compressed and stationary position under vacuum during cutting. The cut material is unloaded after the cutting operation is completed on one or more segments or "bites" of the sheet material. When the layup is held in place by vacuum, a plastic or other air-impermeable overlay is frequently placed on the layup to develop compression forces for compacting the material in addition to holding the layup in position.

Related pattern pieces are grouped into arrays called markers. A marker is usually a rectangular array and allows the related pattern pieces to be cut sequentially from a generally rectangular layup in a single cutting operation. A marker has an origin point, usually at a corner of the marker, from which the positioning of each pattern piece in the marker is referenced. Locating the origin of a marker on a layup therefore determines the location on the layup where the pattern pieces will be cut.

Cutting multiple markers involves significant fixed time costs that are independent of the specific pattern pieces in the markers. Two such fixed time costs are the time for the cutting tool to travel between markers, or "dry haul" time, and setup time to load the cutting table, which includes the time spent covering the material with the plastic overlay, loading the material onto the table, and advancing the material to the next bite.

Cutting multiple markers also requires consumables costs in loading the cutting table. A fixed amount of underlay and/or overlay material in used for each bite, regardless of the number or size of the pattern pieces to be cut from that bite. Some materials are provided in standard widths that are less than half the width of the cutting table. Much of the underlay and overlay material is therefor wasted in cutting these layups.

Some markers, such as those needed in producing T-shirts, also require symmetric features to be cut from a layup of tubular material. Accordingly, the marker must be precisely centered with respect to the layup. Otherwise, the cut pattern pieces will not be aligned with the axis of the tubular material and the resulting garment will be flawed.

Precise centering of a marker is also required when the material to be cut is ornamented, such as striped material. Markers that are not precisely centered with respect to the ornamentation will result in cut pattern pieces with misaligned patterns.

It would be advantageous to reduce the total fixed time and consumables costs in cutting multiple markers. It would also be advantageous to locate the origin point of the marker such that the centerline of the marker corresponds to the centerline of the layup.

It is, accordingly, a general object of the present invention to provide a method and apparatus for cutting multiple layups of sheet material positioned in a side-by-side relationship by combining multiple markers into a single marker.

It is a further object of the present invention to provide a method for cutting layups of sheet material where the origin points of the markers are registered relative to the center of the fabric.

SUMMARY OF THE INVENTION

One aspect of the present invention is to provide a method and apparatus for working on sheet material, particularly limp sheet material, and cutting multiple layups of sheet material positioned in a side-by-side relationship. The costs in setting up two layups that are in a side-by-side relationship are the same as those incurred in loading a single layup onto the bed. Thus, multiple markers that are in a side-by-side relationship can be cut without incurring extra setup costs. The dry haul time between markers in a side-by-side relationship is also reduced as the cutting tool does not travel as far between markers.

According to the present invention, a method and apparatus of the foregoing type includes a cutting table for holding multiple layups of sheet material side-by-side. A cutting tool movable relative to the cutting table cuts pattern pieces in markers from each layup. An origin setting means is also included to register the location of the origin of each marker of each layup with respect to the cutting table surface. A programming means responsive to the origin settings means combines the markers of layups positioned side-by-side on the cutting table surface, allowing the markers to be cut as a single marker.

Another aspect of the present invention is to provide a method and apparatus for determining the centerline of the layup and registering the origin point of the marker relative to the centerline so that one half of the marker is disposed on one side of the centerline and the other half is disposed on the other.

DESCRIPTION OF THE PREFERRED EMBODIMENTS

Figure 1:
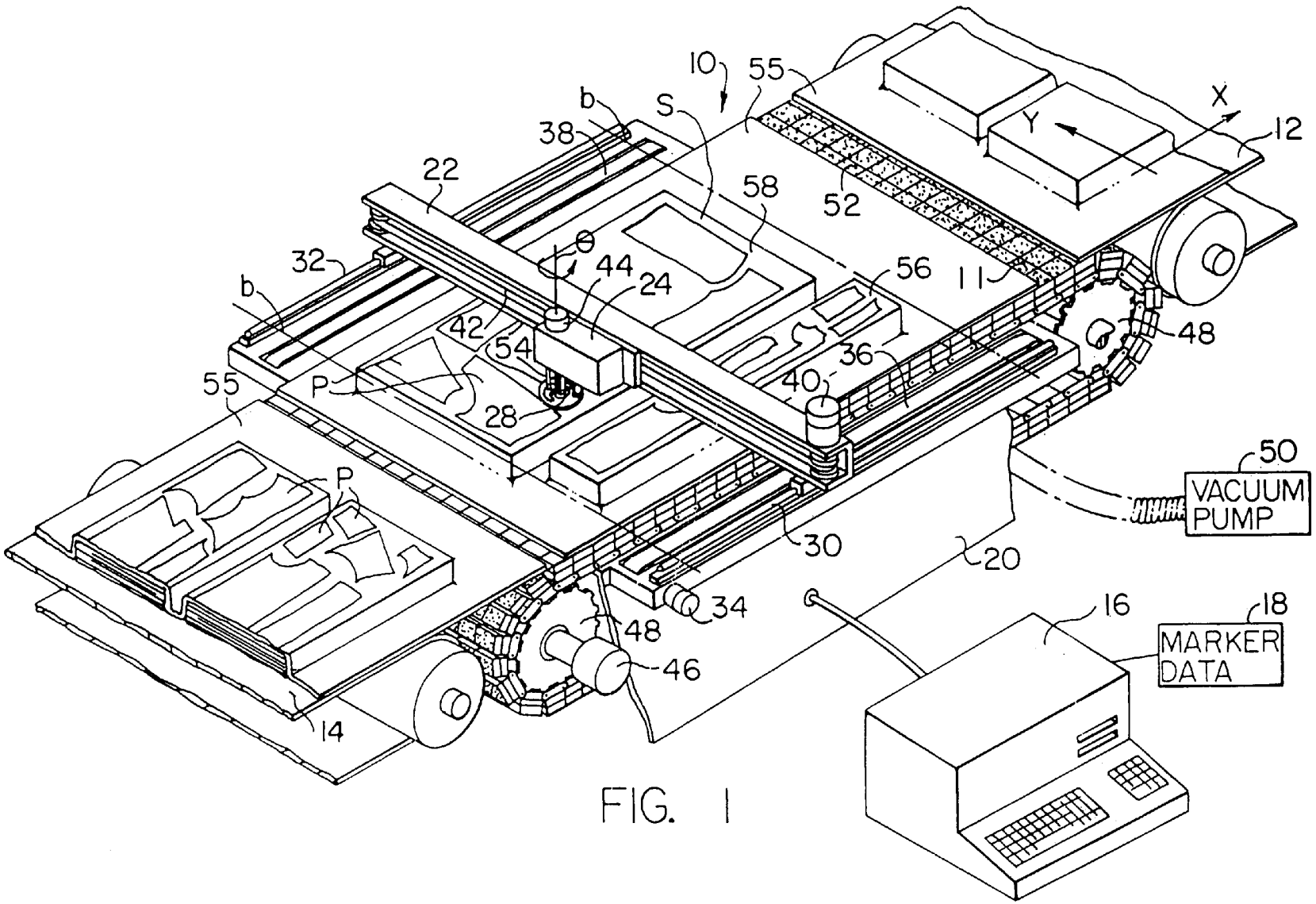
FIG. 1 is a perspective view of a cutting machine with multiple layups of sheet material positioned in a side-by-side relationship for cutting in accordance with the present invention.

FIG. 1 illustrates a numerically controlled cutting machine, generally designated 10, for cutting pattern pieces from a length of sheet material S that is spread over a cutting table 11. As illustrated, the cutting machine cuts a plurality of closely nested pattern pieces P in an array referred to in the garment industry as a marker. However, the invention described hereinafter is not limited to the garment industry and may be used in a wide range of work operations on sheet material which is drilled or cut by many different types of tools including reciprocating cutting blades, ultrasonic knives, rotatable knives, laser beams or water jets.

The cutting table 11 of the cutting machine 10 is a conveyor table. The sheet material S is loaded onto the cutting table 11 from a spreading and loading conveyor 12 and cut by the cutting machine 10 on the cutting table 11. The cut pattern pieces together with the surrounding material are unloaded from the cutting table by means of an unloading conveyor 14. Eventually the cut pattern pieces P are removed from the unloading conveyor and are transported to a sewing room for assembly into a garment.

The length of the marker or array of pattern pieces that is cut from the sheet material S may be substantially larger than the cutting machine itself. Under such circumstances the material is fed in segments or "bites" onto the cutting table 11 for cutting all of those pattern pieces P in the one segment of the marker while the material is stationary on the cutting table 11. Thereafter, the next segment is fed onto the cutting table, and the previously-cut pieces are drawn onto the unloading conveyor 14. The sequence of alternately feeding and cutting the material is controlled by a computer 16 to which signals indicative of the marker data from memory 18 are supplied and continues until the entire marker has been cut.

The cutting machine 10 includes an X-drive carriage 22 which is moveable back and forth relative to the base 20 in the illustrated X-coordinate direction, and a Y-carriage 24 which is mounted on the X-carriage 22 for movement therewith and is moveable relative to the X-carriage back and forth relative to the base in the illustrated Y-coordinate direction. A cutting tool in the form of a reciprocating cutting blade 28 is suspended from the Y-carriage 24 and can be moved up or down relative to the carriage to be brought into and out of cutting engagement with the sheet material S. The cutting blade is also rotatable about the θ-axis in order to be oriented generally tangentially of cutting paths defined by the peripheries of the pattern pieces P.

The X-carriage 22 rides on stationary roundways 30 and 32 at opposite sides of the cutting table and is driven back and forth in the illustrated X-coordinate direction by means of an X-drive motor 34 and a pair of drive belts 36, 38 coupled to the carriage 22 at each side of the table. The Y-carriage 24 is moved back and forth on the X-carriage relative to the sheet material in the illustrated Y-coordinate direction by means of a servomotor 40 and a drive belt 42 trained over pulleys at opposite ends of the X-carriage.

The rotation of the cutting blade 28 about the θ-axis is accomplished by the θ-servomotor 44 mounted on the Y-carriage 24. In addition, the cutting blade is lifted from or plunged into cutting relationship with the sheet material by means of a servomotor not shown.

Collectively the X-servomotor 34, the Y-servomotor 40 and the θ-servomotor 44 cooperate to move the cutting blade 28 in cutting engagement with the sheet material at the periphery of the pattern pieces in response to commands transmitted to the motors from the control computer 16 in response to the signals indicative of the marker data in the computer memory 18. Additionally, the computer 16 controls the bite feeding of the sheet material onto and off of the cutting table 11 as well as the operation of the loading and unloading conveyors 12 and 14.

As indicated above, the cutting table 11 is a conveyor table on which the sheet material S is loaded from the loading conveyor 12, then cut by the cutting blade 28 and then discharged onto the unloading conveyor 14. While the material is being cut, the cutting table 11 and the segment of material S on the table remains stationary with respect to the base 20. Thus, the cutting blade 28 performs all of the cutting motions.

To accommodate the cutting blade, the cutting table 11 is formed by a penetrable bed 52 of bristle blocks whose bristles project upwardly into a plane defining the support surface of the table. The bristle blocks are arranged in rows extending in the Y-coordinate direction forming a conveyor that can be driven in the illustrated X-coordinate direction by the drive motor 46 and drive sprockets 48 in FIG. 1.

The bristle blocks have perforate bases or are spaced slightly from one another for air permeability and are coupled to a vacuum pump 50 that evacuates the region of the bristles and the associated support surface of the table 11 at least in the vicinity of the cutting blade 28, if the table is provided with vacuum zoning. By drawing a vacuum at the support surface through the air permeable bristle bed and with a plastic overlay 55 covering the sheet material S, the sheet material is drawn toward the support surface of the bristles and held firmly in position during cutting. For further details concerning the construction and operation of such a table, reference may be had to U.S. Pat. Nos. 4,646,911 or 5,189,936.

In accordance with the present invention, the cutting machine 10 and the method carried out by the machine make possible the simultaneous cutting of multiple layups 56 and 58 arranged in side-by-side relationship on the cutting table 11. Multiple markers, one for each of the layups, are used, some or all of which may require bite feeding. In conventional fashion all the pattern pieces that fall within one bite between the lines b—b in FIG. 1 are cut, then the table is advanced before the pattern pieces that are in the next bite are cut.

Figure 2:
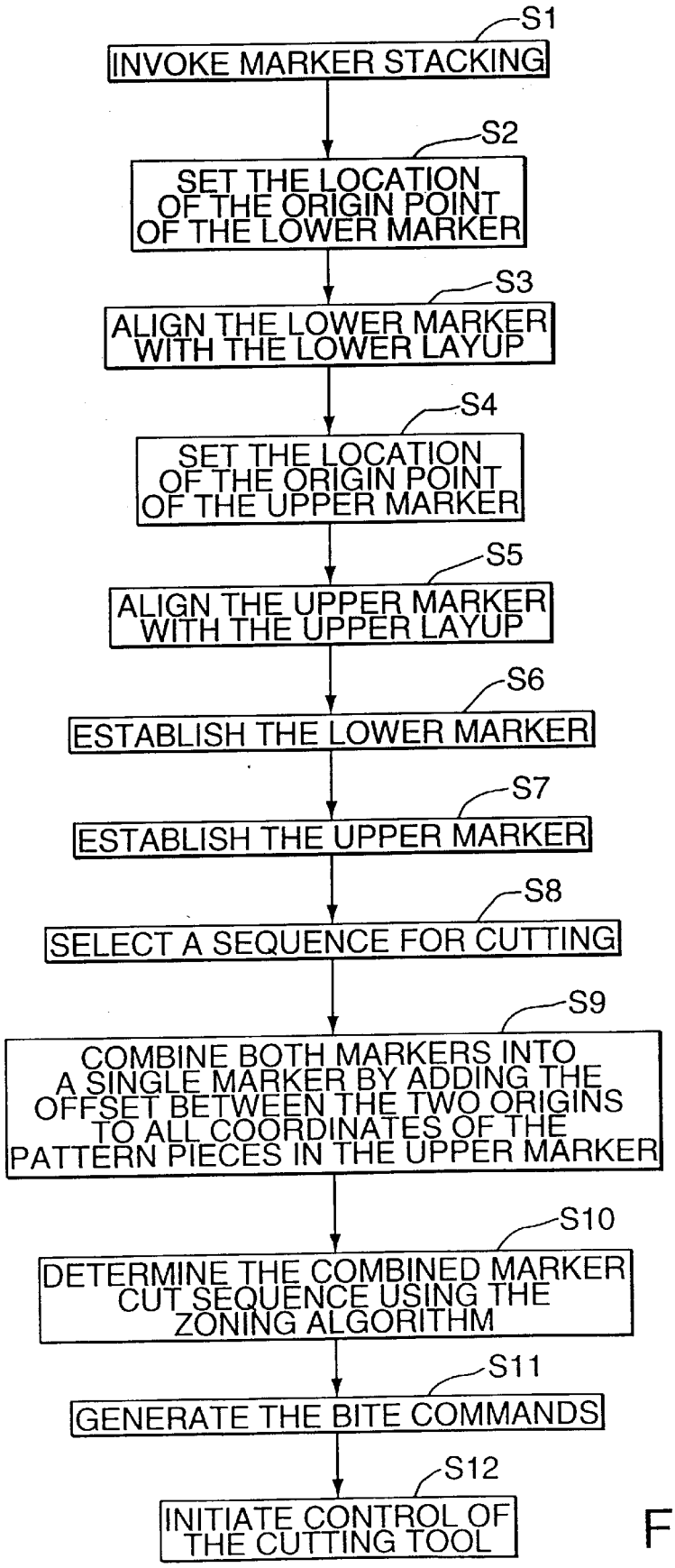
FIG. 2 is a flow chart showing the steps involved in cutting multiple layups of sheet material positioned in a side-by-side relationship in accordance with the present invention.

The process for side-by-side marker stacking carried out by the machine 10 is illustrated in FIG. 2. After two layups are positioned on the cutting table and covered with overlay material 55, the user invokes the side-by-side stacking mode via the computer 16, as shown in S1. This mode requires the user to set the location of the first marker's origin, as shown in S2. A preferred method of setting the location of the origin is by positioning a light pointer 54 such that the light pointer illuminates the desired origin location on the first layup and then registering that point via the computer 16. Once the first marker's origin has been set, the user uses the computer 16 to align the first marker with respect to the first layup, as shown in S3. A preferred method of aligning the marker is to select two points on an edge of the marker by positioning a light pointer 54 such that the light pointer illuminates the desired points, and then registering those points via the computer 16. Alignment is necessary for layups of tubular material or ornamented material, where cuts that do not have a specific orientation relative to the layup result in flawed garments.

The user then sets the location of the second marker's origin, as shown in S4, preferably by positioning a light pointer 54 such that the light pointer illuminates the desired origin location on the second layup and then registering that point via the computer 16. Once the second marker's origin has been set, the user uses the computer 16 to align the second marker with respect to the second layup, as shown in S5. This alignment may be different from the alignment chosen for the first marker since the position of the two layups will not necessarily be the same.

The two established markers are then selected from the list of markers stored in the computer memory 18, as shown in S6 and S7. The user also chooses one of two sequences for cutting to direct the cutting tool, as shown in S8. The first sequence for cutting minimizes vacuum loss and maximizes throughput. With this sequence the cutting area is divided into lateral zones and the cutting tool cuts pattern pieces of adjacent zones consecutively. Instead of cutting the entire bite of one marker and then going on to the other marker, the cutting tool alternates between the two markers. Starting at the −X, −Y corner of the first marker and working towards the +Y edge of the second marker, the cutting tool cuts all pieces that are located within the first zone. Once the cutting tool has cut all pattern pieces in the first zone, the cutting tool starts cutting the pattern pieces at the +Y edge of the next zone and work towards the −Y edge. The cutting tool thus progresses in an "S" path gradually working from the −X to the +X direction.

The second sequence for cutting preserves special piece sequencing, such as cutting small pieces first, that the user may require. Instead of the sequence mentioned above, the cutting tool cuts all of the pattern pieces of the entire bite of the first marker before cutting the pattern pieces of the entire bite of the second marker. The process is repeated for subsequent bites.

Once a sequence for cutting has been selected, the apparatus combines the markers to generate a single marker, as shown in S9. The single marker includes the cut information from both of the original markers. In this new marker, the coordinates of the second marker are modified to be relative to the origin position of the first marker. That is, the offset between the origins of the first marker and second marker is added to the coordinates of the pattern pieces in the second marker.

In accordance with the previously selected cut sequencing method, the computer 16 generates the combined cut sequence, as shown in S10, which renumbers the order in which the pieces are cut. The computer 16 then generates a single set of bite commands which control the feeding of subsequent bites of the layup onto the cutting table, as shown in S11. The user then initiates control of the cutting tool, as shown in S12, as he would for other marker.

Figure 3:
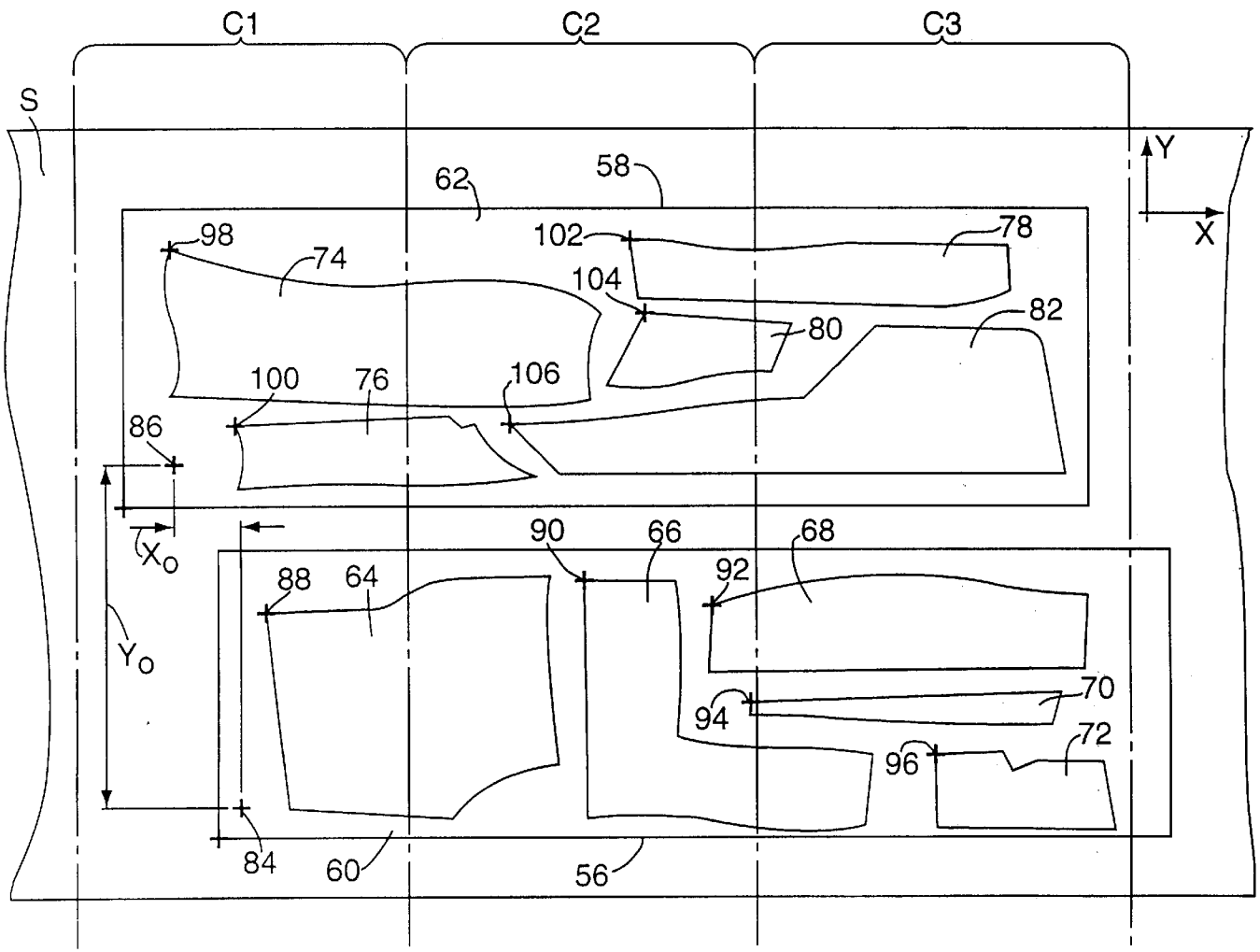
FIG. 3 is a top plan view of two markers superimposed upon two layups of sheet material positioned in a side-by-side relationship on the cutting machine.

Turning now to FIG. 3, an example of how the present invention is used to cut two markers 60 and 62 upon a length of sheet material S is described. The first marker 60 contains pattern pieces 64, 66, 68, 70 and 72. The second marker 62 contains pattern pieces 74, 76, 78, 80 and 82. The first marker's origin 84 is the reference point from which the origins 88, 90, 92, 94 and 96 of the pattern pieces 64, 66, 68, 70 and 72 are measured. Similarly, the second marker's origin 86 is the reference point from which the origins 98, 100, 102, 104 and 106 of the pattern pieces 74, 76, 78, 80 and 82 are measured.

The length of sheet material S is divided into cutting zones C1, C2 and C3 for use in the cutting method whereby pattern pieces of adjacent zones are cut consecutively. All pattern pieces whose origins fall within the first zone C1, namely pattern pieces 64, 76 and 74, are cut first. All pattern pieces whose origins fall within the second zone C2, namely pattern pieces 66, 68, 70, 82, 80 and 78 are cut after the pattern pieces in the first zone C1 are cut. Finally, all pattern pieces whose origins fall within the third zone C3, only pattern piece 72, are cut after the pattern pieces in the second zone C2 are cut.

Upon combining the first marker 60 and the second marker 62, the origins of the pattern pieces 74, 76, 78, 80 and 82 are modified to be referenced to the origin position 84 of the first marker 60. The X coordinates of the origins 98, 100, 102, 104 and 106 are decreased by the amount $X_0$ which is the distance between the origin 84 and the origin 86 in the +X direction. The Y coordinates of the origins 98, 100, 102, 104 and 106 are increased by the amount $Y_0$ which is the distance between the origin 84 and the origin 86 in the −Y direction.

The cutting tool begins cutting those pieces in the first zone C1 that are closest to the −Y end of the zone C1. Accordingly, pattern piece 64 is cut first, followed by pattern piece 76, and finally pattern piece 74. After the pieces in the first zone C1 have been cut, the cutting tool is at the +Y edge of the zone C1. In proceeding to cut the pattern pieces that are in the second zone C2, the cutting tool starts at the pattern pieces nearest to the +Y edge of the zone C2 and proceeds to the pattern pieces nearest to the −Y end of the zone C2. Accordingly, the pattern piece 78 is the first cut in zone C2, followed by pattern pieces 80, 82, 66, 68 and 94. After the pieces in the second zone C2 have been cut, the cutting tool is at the −Y edge of the zone C2. In proceeding to cut the pattern pieces that are in the third zone C3, the cutting tool starts at the pattern pieces nearest to the −Y edge of the zone C3 and proceeds to the pattern pieces nearest to the +Y end of the zone C3.

Registering the origins of the markers relative to the center of each layup is advantageous in that it allows the marker to be precisely centered upon the layup. This allows symmetric features to be cut from tubular material without misaligning the cuts of the pattern pieces with the axis of the tubular material. It also allows pattern pieces that are cut from ornamented material to have a desired ornamentation at a precise position on the cut pattern pieces. Markers that are not precisely centered with respect to the ornamentation will result in cut pattern pieces with misaligned ornamentation. Two methods for registering the origins of the markers relative to the center of the layup are disclosed. It is useful to note that registering the origins of the markers relative to the center of each layup may be performed upon a plurality of layups positioned in a side-by-side relationship, or upon a single layup.

Figure 4:
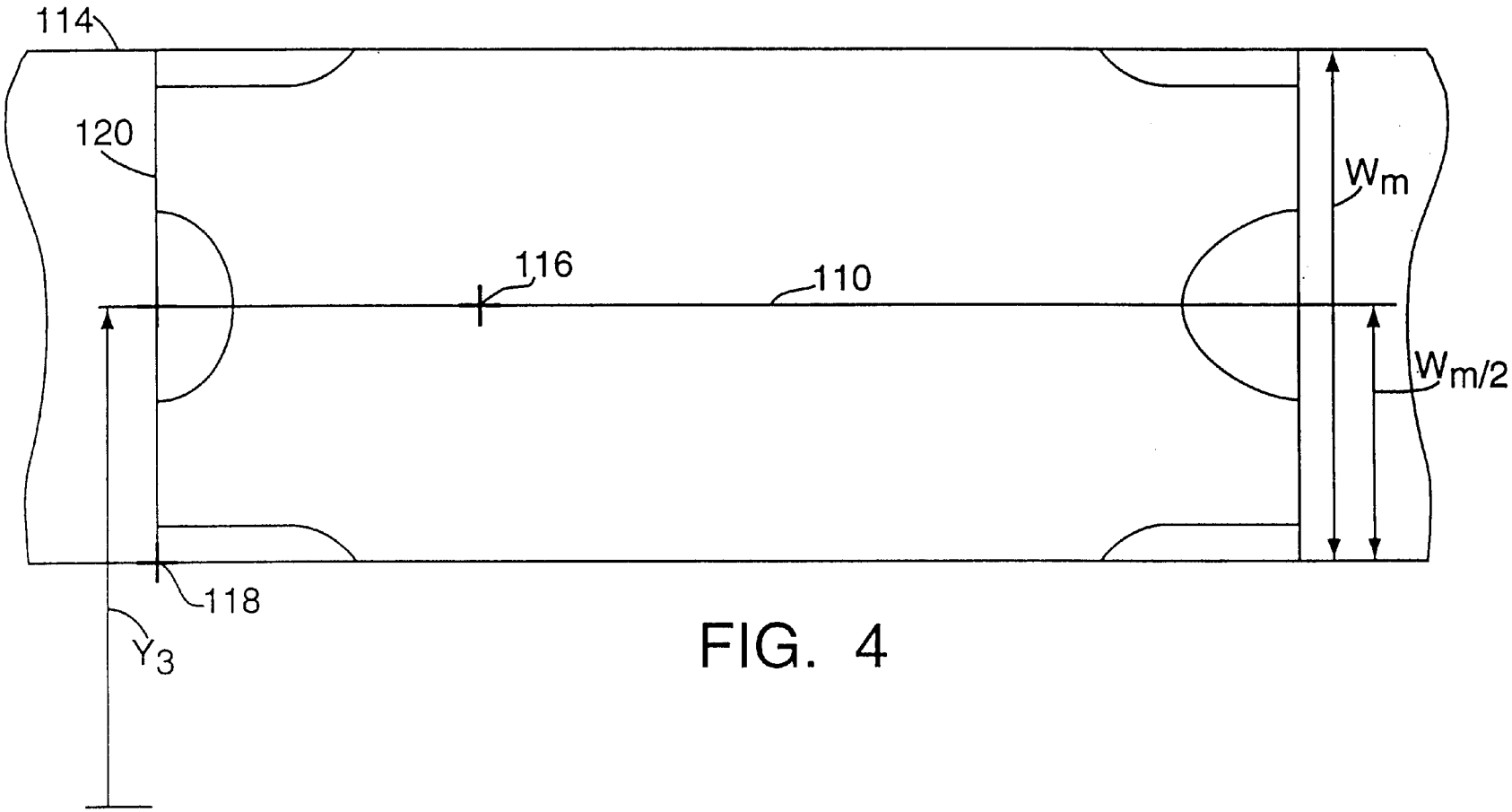
FIG. 4 is a top plan view of a marker having an origin which is established relative to the center of the layup, the center being manually identified.
Figure 5:
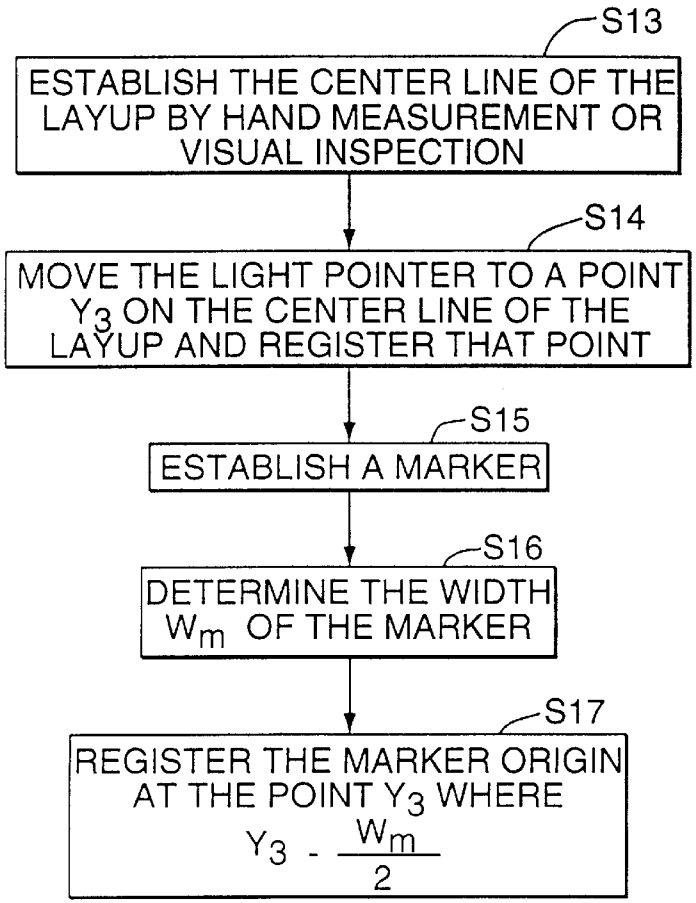
FIG. 5 is a flow chart showing the steps involved in registering the marker origin relative to the center of the layup, the center being manually identified.

Turning to FIGS. 4 and 5, the first method for registering the origin of the marker relative to the center of the layup consists of centering the marker 120 on the centerline 110 of the layup 114. The centerline may be established by hand measurement or visual inspection, as shown by S13. For example, the centerline may be indicated by a centered ornamentation on the layup 114 such as a stripe. With such a centered ornamentation, determining the centerline 110 of the layup 114 is accomplished by visual inspection. The centerline 110 of the layup 114 can also be determined by measuring the width of the layup between the sides. The location of the centerline 110 is then determined as halfway between this width.

Once the centerline 110 has been determined, any point on this line is registered, as shown in S14, so that the computer 16 can store the Y coordinate $Y_3$ of the location of the centerline 110 in memory 18 for use in registering the origin point of the marker. A preferred method of registering the location of a center point 116 on the centerline 110 of the layup 114 is by positioning the light pointer 54 (FIG. 1) such that it illuminates a desired center point 116 location and pressing an origin switch on the computer 116. After the location of the center point 116 is registered, the marker 120 is established, as shown in S15, by user selection through the computer 16 and the marker width $w_m$ is determined, as shown in S16. The marker width $w_m$ is divided by two and the resulting half-width $w_m/2$ is subtracted from the Y coordinate $Y_3$ of the selected center point 116 to calculate the Y coordinate of the origin 118 of the marker 120, as shown in S17. The following equation describes the calculation of the Y coordinate of the origin 118 of the marker 120:

$$Y_3 - \frac{w_m}{2}$$

The cutting tool can then cut the layup 114 in accordance with the marker as registered.

Figure 7:
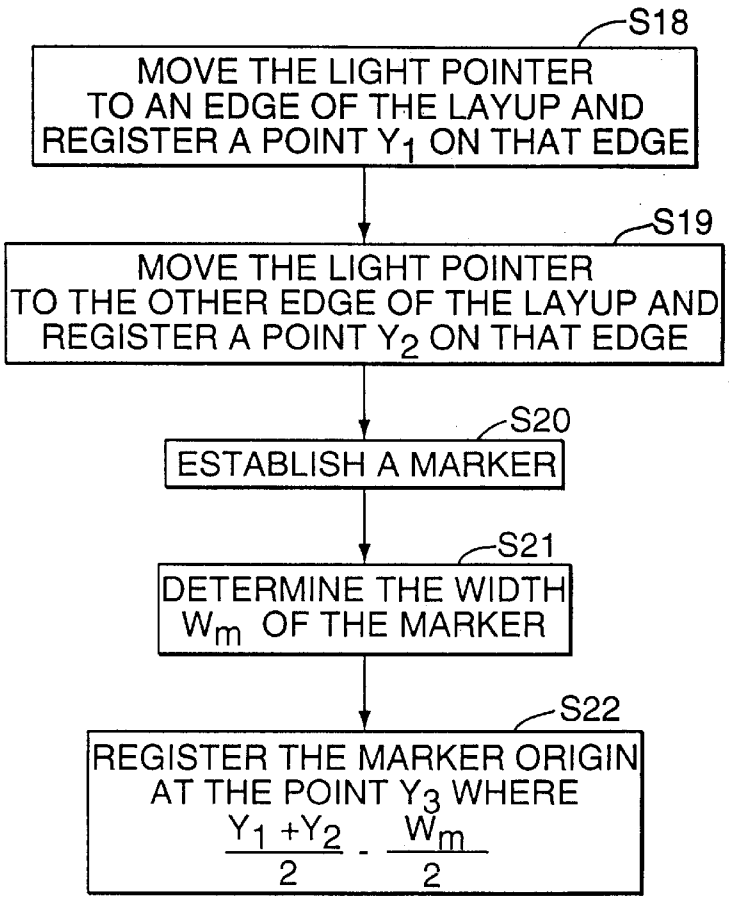
FIG. 7 is a flow chart showing the steps involved in registering the marker origin relative to the center of the layup, the center being calculated by registering two end points.
Figure 6:
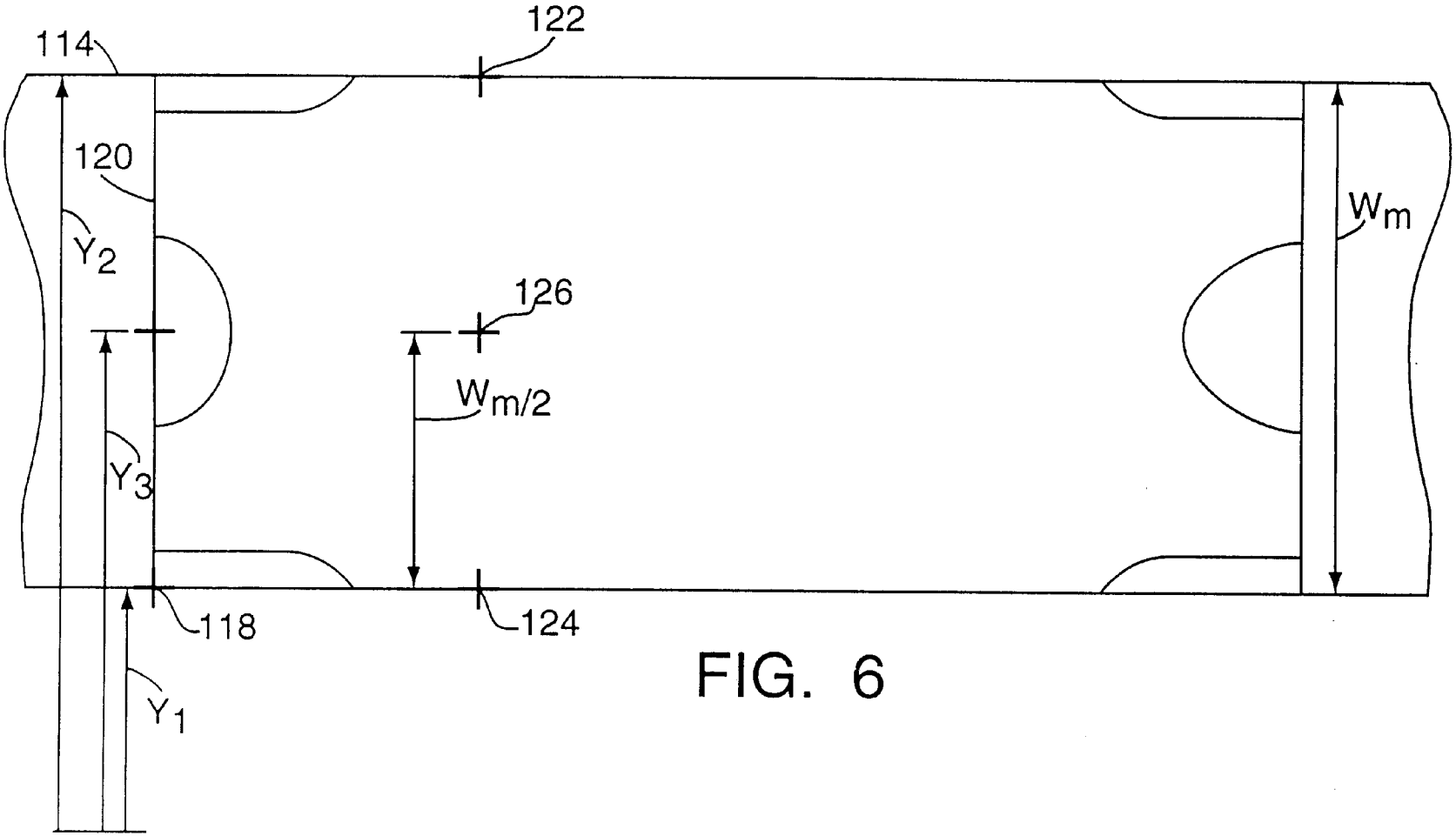
FIG. 6 is a top plan view of a marker having an origin which is established relative to the center of the layup, the center being calculated two edge points.

A second method for registering the origins of the markers relative to the center of the layup, depicted in FIGS. 6 and 7, allows the centering of a marker 120 on a layup 114 without having to manually measure or calculate the centerline. The user locates the top and bottom edges 122 and 124 of the layup 114 preferably by positioning a light pointer such that the light pointer illuminates the desired corner points 122 and 124 of the layup 114, as shown in S18 and S 19. The marker 120 is then established or identified in memory, as shown in S20, and the marker width $w_m$ is determined, as shown in S21. The Y coordinate $Y_3$ of the center point 126 of the layup 114 is calculated as the average of the Y coordinates $Y_2$ and $Y_1$ of the two selected points 122 and 124, in accordance with the following equation:

$$Y_3 = \frac{Y_1 + Y_2}{2}$$

The marker width $w_m$ is divided by two and the resulting half-width $w_m/2$ is subtracted from the Y coordinate of the center point 126 to calculate the Y coordinate of the origin 118 of the marker 120, as shown in S22, in accordance with the following equation:

$$\frac{Y_1 + Y_2}{2} - \frac{w_m}{2}$$

The cutting tool can then cut the layup 114 in accordance with the marker as registered.

While the present invention has been described in several embodiments, it should be understood that numerous modifications and substitutions can be employed without departing form the spirit of the invention. For example, although the cutting of side-by-side layups has been described in one form by combining the markers into a single marker for cutting, multiple side-by-side layups can be cut individually in accordance with their respective markers without the combining step and many of the advantages of the invention such as savings in set-up time and consumables can still be enjoyed. Accordingly, the present invention has been described in a preferred embodiment by way of illustration rather than limitation.

We claim:

1. Apparatus for cutting a multiple number of layups of sheet material according to a multiple number of markers each associated with a respective one of the layups and each marker including data on at least one pattern piece to be cut the apparatus comprising:

a cutting table defining a support surface extending in longitudinal and transverse directions for holding the multiple number of layups of sheet material on the support surface during a cutting operation with at least some of the layups being arranged in side-by-side relationship;

a tool support extending in the transverse direction from one side of the cutting table to the other side of the cutting table;

a cutting tool mounted to the tool support and movable relative to the support surface in cutting engagement with the layups on the surface to cut pattern pieces from the layups in accordance with the markers;

origin setting means for setting a location of an origin of each marker of each layup with respect to the support surface of the cutting table; and programming means responsive to the origin setting means for enabling the cutting tool to cut pattern pieces deriving from different markers and positioned on different layups in side-by-side relationship with one another along a cutting path generally progressively advancing along the longitudinal direction of the support surface of the cutting table in a single cutting operation.

2. Apparatus for cutting multiple layups of sheet material as defined in claim 1 wherein the programming means includes means for combining a first marker associated with a first layup with a second marker associated with a second layup positioned in side-by-side relationship with the first layup to form a single marker by offsetting coordinates of the origin of the second marker from coordinates of the origin of the first marker for cutting together pattern pieces from both the first and second layups.

3. Apparatus for cutting multiple layups of sheet material as defined in claim 1 wherein:

the cutting table defining the support surface is a conveyor table for moving adjacent segments or "bites" of side-by-side layups into a cutting area on the support surface of the table for cutting together.

4. Apparatus for cutting multiple layups of sheet material as defined in claim 1 wherein:

the programming means further includes:

means for assigning each pattern piece of a number of markers associated with a number of layups arranged side-by-side on the support surface to one of a plurality of cutting zones adjacent to and following one another in the longitudinal direction of the support surface with each zone extending in the transverse direction across the support surface, the assigned zone for each pattern piece being one in which at least a portion of that pattern piece lies; and sequencing means for causing the cutting tool to cut from the side-by-side layups all of the pattern pieces of the side-by-side layups assigned to one cutting zone before cutting from the side-by-side layups all of the pattern pieces assigned to another cutting zone.

5. Apparatus as defined in claim 4 wherein the sequencing means causes the cutting tool to cut pattern pieces assigned to a cutting zone and to progressively move in the longitudinal direction to a next adjacent cutting zone to cut pattern pieces assigned to the next adjacent cutting zone.

6. Apparatus for cutting multiple layups of sheet material as defined in claim 1 further including:

means for spreading the layup and overlaying the layups with plastic or similar material before loading onto the cutting table.

7. Apparatus for cutting multiple layups of sheet material as defined in claim 1 further including:

means for aligning one marker with ornamentation imprinted upon an associated layup, thereby imparting a desired alignment of the ornamentation upon the pattern pieces of the associated layup.

8. Apparatus for cutting multiple layups of sheet material as defined in claim 1 further including:

means for aligning one marker with the edges of the associated layup.

* * * * *